US005082328A

United States Patent [19]

Garelick

[11] Patent Number: 5,082,328

[45] Date of Patent: Jan. 21, 1992

[54] SWIVEL-SLIDE SEAT

[76] Inventor: Richard J. Garelick, 3324 Edmund Blvd., Minneapolis, Minn. 55406

[21] Appl. No.: 597,177

[22] Filed: Oct. 15, 1990

[51] Int. Cl.[5] ..... A47C 1/00

[52] U.S. Cl. ..... 297/344; 248/418; 248/415; 297/349

[58] Field of Search ..... 297/349, 344; 248/415, 248/418, 425

[56] References Cited

U.S. PATENT DOCUMENTS

| | | | |
|---|---|---|---|
| 2,914,793 | 12/1959 | McMahan, Sr. | 297/349 |
| 3,113,804 | 12/1963 | Ritter | 297/349 |
| 3,593,954 | 7/1971 | Ritchie | 297/349 |
| 3,718,365 | 2/1973 | Gibson | 297/344 |
| 3,724,798 | 4/1973 | Lucasey | 248/418 |
| 3,789,444 | 2/1974 | McCord | 297/349 |
| 4,477,050 | 10/1984 | Thompson et al. | 248/425 |
| 4,557,520 | 12/1985 | Simjion | 297/349 |
| 4,705,256 | 11/1987 | Hofrichter | 248/425 |
| 4,971,392 | 11/1990 | Young | 297/349 |

*Primary Examiner*—Kenneth J. Dorner
*Assistant Examiner*—Cassandra Hope
*Attorney, Agent, or Firm*—Jacobson and Johnson

[57] ABSTRACT

A pair of metal plates sandwich a spacer made of low-friction material and a relatively large diameter circular opening passes through the three members which are held rotatably together by a flared ring or bushing or collar along the edge of the opening. One of the plates is mounted to the floor and a seat is coupled to the other plate. The seat may be attached to a slide carriage comprising one of the aforementioned swivel plates and another rectangular plate, each plate having tracks and rails along parallel outer edges which slidably mate with respectively corresponding rails and tracks on the other plate.

9 Claims, 3 Drawing Sheets

SWIVEL-SLIDE SEAT

FIELD OF THE INVENTION

This invention is directed toward apparatus for swivably mounting a seat to a supporting floor. More particularly, it is directed toward apparatus for swivably mounting a boat seat to the deck of a boat. The invention further provides a swivel apparatus in combination with a slide apparatus so that the seat can be swung around to any orientation and can be slidably adjusted back and forth. The swivel is constructed in a fashion to withstand forces even greater than those normally encountered in the use of a swivel-slide boat seat so that the apparatus will operate reliably and will be durable.

DESCRIPTION OF THE PRIOR ART

There are a number of commercially available swiveled boat seats. Conventionally, the swivel comprises a number of ballbearings suitably and rotatably resting in suitable races or recesses between adjoining disks. One of the disks is normally coupled to the boat seat and the other secured in some fashion to the boat deck, either directly or through a support post or pillar, so that the user can swing the seat around as he or she desires. There are also a number of commercially available slides for boat seats including the slide apparatus which is described hereinbelow. Although there are known boat seats that are both swivable and slidably adjustable, in general it has been found that these combined swivel-slide boat seats do not operate reliably under the conditions encountered aboard a boat. Oftentimes the swivel cannot stand up to the forces brought to bear on it when the seat is slidably adjusted to various positions. After a while the swivel mechanism will often break or jam up and not operate smoothly. Also, the environmental conditions under which a boat seat is used oftentimes is not compatible with continuous smooth and reliable operation of a conventional ballbearing swivel mechanism, and more so when used in conjunction with a slide adjustment.

SUMMARY OF THE INVENTION

A pair of rigid plate members, one adaptable for attachment or coupling to a boat seat and the other adaptable for attachment or coupling to a supporting boat deck, rest one on top of the other with a low friction thin washer between them and a centralized relatively large diameter circular opening through the plate members and the washer. A rigid band or ring or collar or bushing having flared upper and lower edges encircles the opening to hold the assembly together while permitting the two plate members to rotate with respect to one another about the collar. Preferably a retaining ring is provided around the collar adjacent one of its flared edges to rest firmly on or against one of the plate members to further assist in reliably holding together the assembled members. The swivel connection constructed in this fashion eliminates the use of the conventional ballbearings resting in races thereby eliminating a place for moisture to gather which could eventually corrode the conventional swivel assembly. In addition, this swivel assembly is much stronger than the conventional ballbearing swivel. It has been found that the relatively large contact area between the collar or bushing and the rotatable plate members in addtion to the holding force of flared edges of the collar or bushing results in a swivel which can successfully withstand a great deal of force, including forces which are well in excess of the forces that are normally encountered in the use of a swiveled boat seat, and, especially, a swivel-slide boat seat.

An embodiment of the invention comprises a combination of a swivel and slide for a boat seat. The slide assembly has two slidably engaged members which form a slide carriage. Each member has a plate section, one of the plate sections adaptable for attachment to a seat and the other constituting one of the plate members of the swivel assembly. A channel or track extends along one edge of each of the plate sections and a slide bar or rail runs parallel along an opposite edge of each of the plate sections of the slide carriage with each of the rails slidably engaged in the track or channel of the other member. An elongated rod having an adjustment knob or handle at one end extends out from one side of the slide carriage and is threaded at its other end into a captive nut located in the track of one of the slide carriage members through the rail of the other member which is slidably engaged with that track and with a stop on the rod outside of the rail. When the rod is threaded into the captive nut, the rails are respectively drawn into tight non-sliding fit against its associated track so that the two members of the slide carriage are securely clamped together on both sides of the slide carriage, thereby eliminating rocking or wobbling and yet providing for the seat to be both swiveled or swung around and slidably adjusted back and forth by the user.

DESCRIPTION OF THE PREFERRED EMBODIMENTS

Figure 1:
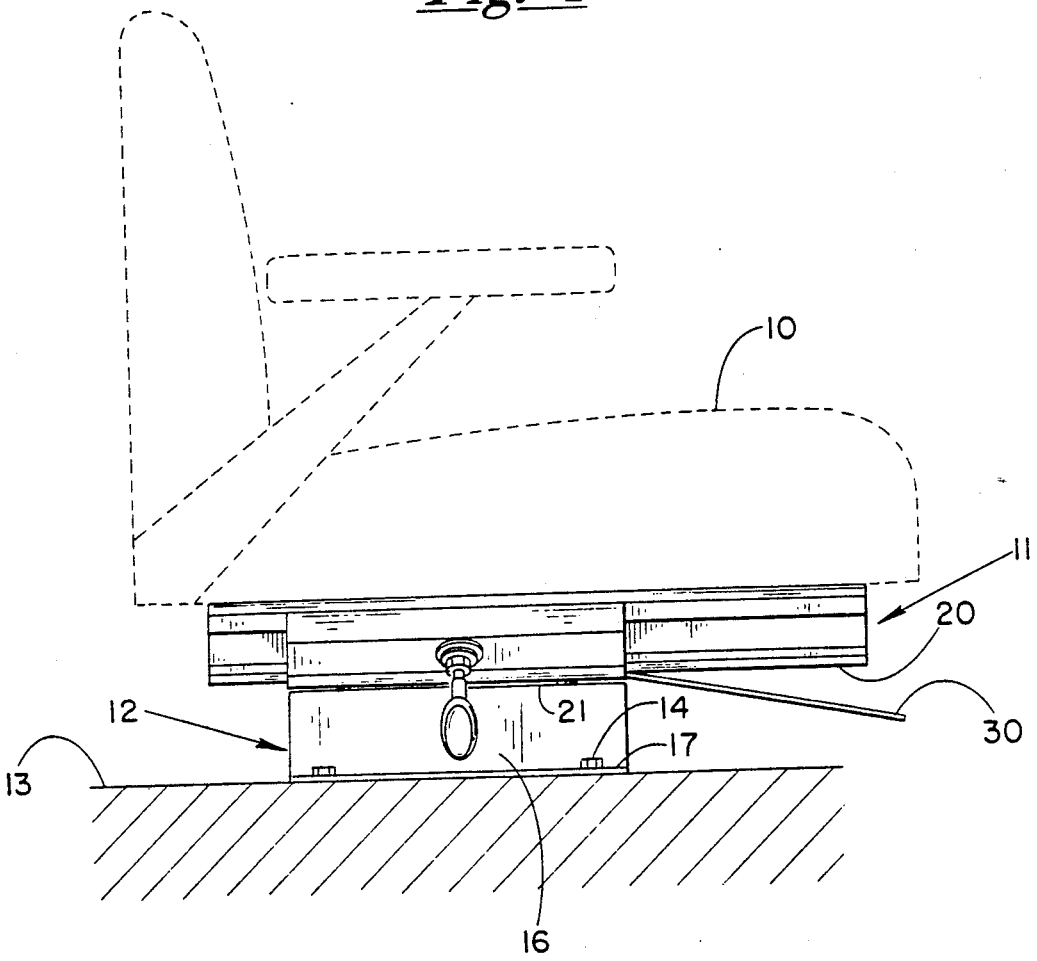
FIG. 1 is a side elevational view illustrating an installation of a preferred embodiment of the invention.
Figure 2:
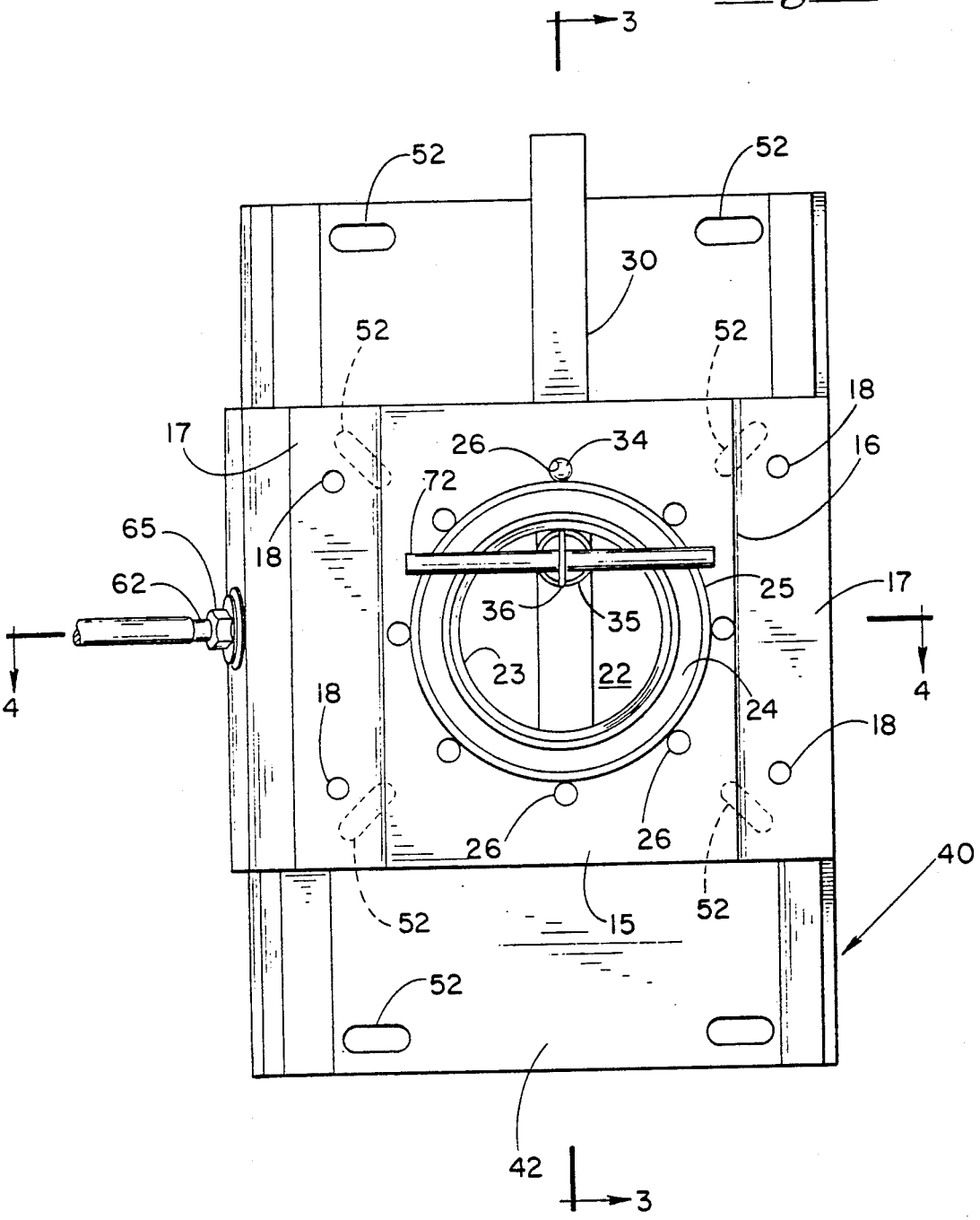
FIG. 2 is a view from the underside of a preferred embodiment of the invention.

With reference to FIG. 1, a conventional boat seat 10 shown in dashed lines, which may take the shape as illustrated or any other conventional shape, is attached by some convenient means and in a conventional fashion, such as by bolts or clamps, to the top of a slide assembly or carriage generally designated by reference numeral 11 which in turn sits on top of a swivel assembly generally designated by reference numeral 12 which rests on and is supported by a boat deck 13 to which it is secured by bolts 14 or the like. As will become apparent later, the boat seat 10 can be attached directly to the swivel assembly if the slide adjustment is not wanted or needed.

Swivel assembly 12 is supported on boat deck 13 by a rigid metal, preferably aluminum, generally U-shaped bracket which has an upper horizontal flat plate section 15 and two generally vertical side walls 16 which terminate at their lower ends with outwardly flared flanges or support legs 17 which rest on the boat deck 13 and have openings 18 for securing bolts 14.

Located above plate section 15 is another horizontal rigid metal, preferably aluminum, plate member 20 with a spacer or washer 21 in the space between plate members 20 and 15. Preferably washer 21 is made out of some suitable type of rigid plastic which has a low coefficient of friction so, as will be described subsequently, the two plate members 15 and 20 will be able to slidably rotate with respect to one another. A material which has been found suitable for this purpose is high density polyethylene. One of ordinary skill in the art will be able to select other suitable materials. Plate members 15 and 20 and washer 21 have concentric, relatively large and equal diameter circular openings generally designated by reference numeral 22. Surrounding openings 22 and in contact with the annular edges of plate members 15 and 20 and washer 21 is a rigid metal, preferably also aluminum, ring or collar or bushing 23 which has its upper and lower edges 23A and 23B, respectively, flared outward so as to securely hold assembled together the two plate members 15 and 20 and intermediate washer 21. For stability, preferably bushing 23 is fixedly attached by a press fit, or possibly by spot welding, to the annular edge of upper plate member 20 and is firmly but slidably pressed against the annular edge of lower plate member 15 such that the two plate members are rotatably slidable with respect to one another around collar 23. It has also been found preferable that washer 21 should move with plate 15 so it is pinned or otherwise fixedly attached in some convenient fashion, not shown, to plate member 15. Plate member section 20 can be adapted for attachment to the underside of a conventional boat seat 10, for example, by merely providing holes through which bolts can be slipped and secured by nuts for attaching the underside of the seat to the top of plate member 20. If constructed in this fashion, then it can be seen with the swivel assembly mounted on and attached to the boat deck as described, the user then can sit in the seat and be able to rotate or swivel the seat in a full circle.

Preferably, in order to further assure that the swivel assembly is held together by collar 23, a generally flat rigid retaining ring 24 is wrapped around the outside of bushing 23 below plate member 15 with another spacer or washer 25 therebetween. The latter is made out of the same material as washer 21. The combination of retaining ring 24 and washer 25 is located at the start of the bend of the flared edge 23B to aid in ensuring that the top and bottom plate members 20 and 15, respectively, and the intermediate washer 21 are maintained in their stable assembled condition as the boat seat is swiveled about.

The swivel assembly may be provided with a hand operable detent locking mechanism for locking the seat at various angular positions. For this purpose plate member 15 has a series of openings or apertures 26 therethrough which are preferably equally angularly spaced around the swivel assembly. Upper plate member 20 is provided with an aperture 27 which is generally the same size as apertures 26. An elongated lever arm 30 is attached at one end via pin 31 to the top side of upper plate member 20. A pair of relatively soft rubber washers or spacers 33 around pin 31 sandwich lever arm 30 and are held in place by head 32 of pin 31. The mounting is such that lever arm 30 can be pivotably swung around pin 31 and the relatively soft rubber washers or spacers 33 keep the lever arm stably secured to pin 31 while allowing lever arm 30 to be lifted at its distal end as necessary for the purpose to be described herein. Lever arm 30 has a jog in it between its attachment to plate member 20 at pin 31 and its free or distal end. Lever arm 30 has a detent pin or short rod 34 which is fixedly attached and which extends downward towards plate member 20 and is dimensioned to fit snugly but removably in aperture 27. A spring 35, which is in expansion, is hooked at one end 36 over a cross bar or rod 72 which is welded or otherwise attached to the bottom edge of collar 23 and at the other end 37 is hooked through a suitable opening to lever arm 30. Spring 35 acts on lever arm 30 tending to pull it downward toward plate member 20. Detent pin 34 is generally located so that it rests in aperture 27 of plate member 20 and when one of the openings or apertures 26 of plate member 15 comes in alignment with aperture 27, spring 35 acting on lever arm 30 pulls pin 34 into engagement with the aligned aperture 26 thereby locking the two plate members 15 and 20 against any further rotation with respect to one another. To unlock the two plates, the user merely pulls up on the distal end of lever arm 30 to disengage pin 34 from aperture 26. The user then can swing or rotate the seat about the swivel as desired. When the user has swung the seat to the desired angle, lever arm 30 is released and pin 34 will then slip into an aperture 26 when one comes aligned with aperture 27. A pair of guide or stop pins 38 (only one of which is shown) extend upward from plate member 20 on each side of the lever arm 30 to generally keep lever arm 30 in line so it extends generally diametrically across the circular opening 22 yet allowing some freedom so that lever arm 30 can be raised to disengage pin 34 from aperture 27 and moved a short distance on either side of aperture 27 so that it rests against plate member 20 and will not engage any of the apertures 26. In this fashion the seat can be continuously swiveled as the user desires and will not lock in place. Whenever the user wants to then lock the seat in place to prevent any further rotation, he or she merely moves lever arm 30 until pin 34 nestles in opening or aperture 27 and swings the seat around until one of the apertures 26 comes in line with aperture 27 and pin 34 will then slide into or engage aperture 26 and lock the two plate members together.

Figure 3:
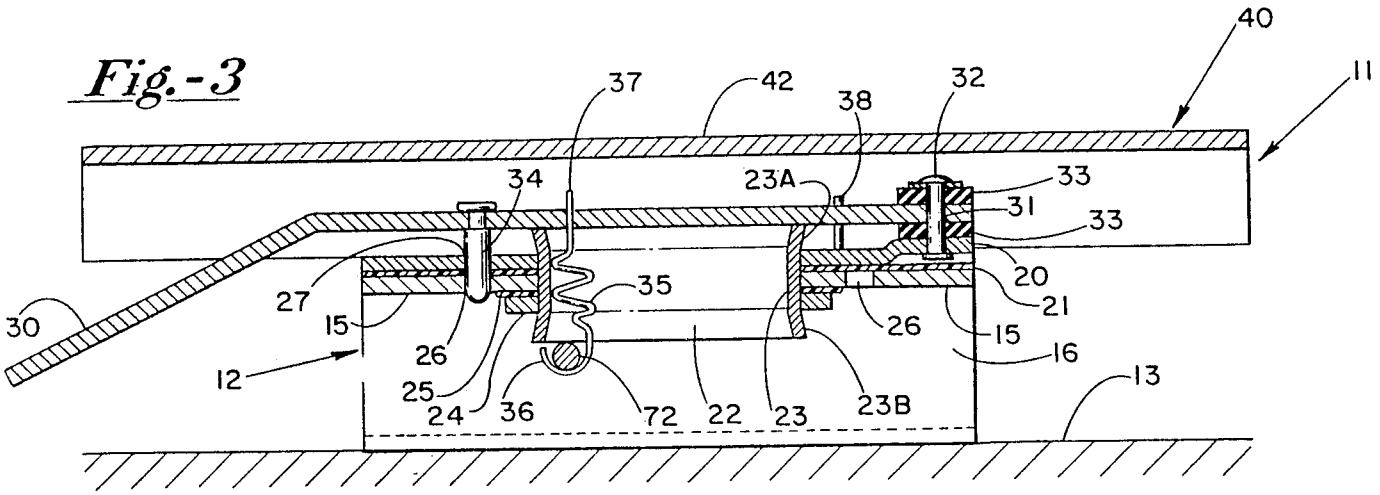
FIG. 3 is a sectioned view as seen via viewing lines 3—3 of FIG. 2.
Figure 4:
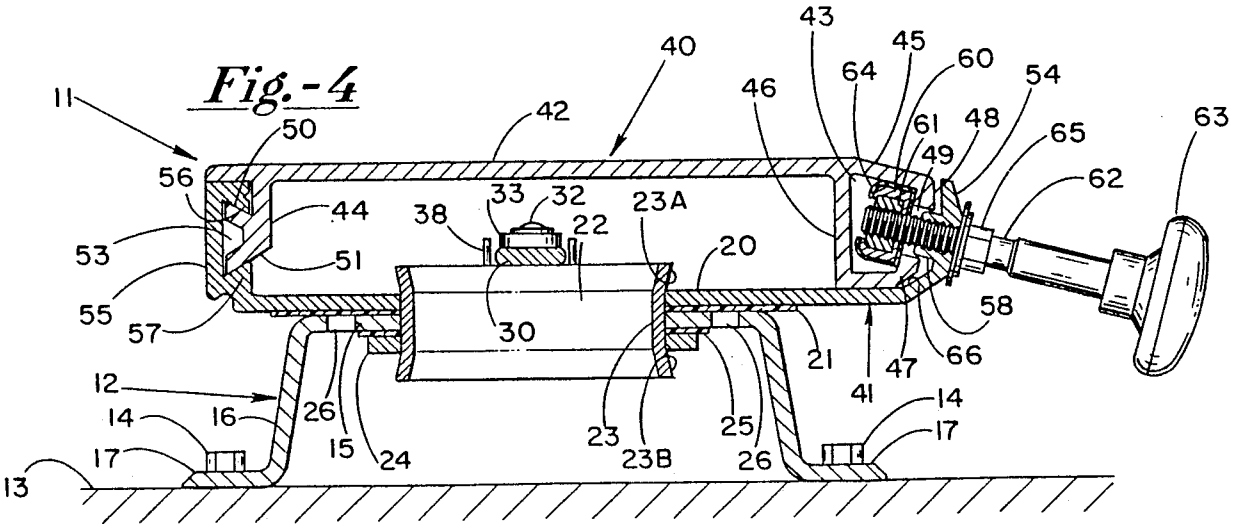
FIG. 4 is a sectioned view as seen via viewing lines 4—4 of FIG. 2.

Alternatively, and preferably, the boat seat 10 is coupled to the swivel assembly via a slide adjustment so that the user can not only swing the seat about as he or she sees fit but also can slidably adjust the seat back and forth for his or her comfort. When the adjustable slide or carriage, generally designated by reference numeral 11, is used with swivel assembly 12 upper plate member 20 constitutes a flat rigid plate section of one of the members of the carriage or slide 1 so that the slide or carriage 11 is then attached or coupled to swivel assembly 12 in the manner as described hereinabove. Slide carriage 11 has a first rigid metal member generally designated by reference numeral 40 which, as viewed in FIGS. 3 and 4, is an upper member and a second rigid metal lower member, generally designated by reference numeral 41, with the two members slidably connected together. Member 40 has a generally rectangular rigid platform or plate section 42, a channel or track generally designated by reference numeral 43, extending below and running along one edge of plate section 42 and a slide bar or rail 44 extending below and running along the opposite edge of plate section 42. Track 43 is defined by a solid upper wall 45, a vertical solid inner wall 46, a solid bottom wall 47, and a generally vertical outer wall 48 which is interrupted by an elongated, open, continuous slot 49. Rail 44 extends downward from the underside of plate section 42 at the opposite edge and has angled V-shaped arms or wings 50 and 51 extending outward at the lower end of rail 44. Plate section 42 has a series of slotted holes 52 through which slide member 40 can be mounted, such as by bolting, to the underside of a seat 10 in the manner as illustrated in FIG. 1.

Slide carriage member 41 has a generally rectangular rigid plate section 20, a track or channel, designated by reference numeral 53, extending upward along one of its edges and a rail 54 extending generally upward along the opposite edge of plate section 20. Track 53 is generally defined by a solid vertical outer wall 55, an upper wall 56 which is in part angled inward and downward from the top of outer wall 55 and a lower wall 57 angled upward and inward from the bottom of outer wall 55. Rail 54 extends upward along the opposite edge of plate section 20 and has an innerfacing continuous hub or stud 58.

The angle of wing or arm 50 on rail 44 is complementary to the angle of upper wall 56 of track 53 mutatis mutandi arm or wing 51 and wall 57 so that rail 44 is supported in and is free to slide back and forth longitudinally within the confines of track or channel 53. At the opposite edges of members 40 and 41 the bottom wall 47 of track 43 slidably rests in part on the top surface of plate section 20 and hub 58 of rail 54 is slidably engaged in slot 49 of track 43 so that track 43 can be slid longitudinally back and forth with respect to rail 54.

A metal bracket 60 which holds captive a square or angled body nut 61 is located in track 43 and is ordinarily free to slide back and forth within the confines of track 43. A clamping rod 62 having a knob or handle 63 at its outer distal end extends outward from a side of the slide carriage 11 and at its proximal end passes through hub or stud 58 on rail 54 into threadable engagement with nut 61. A polyethylene or plastic sleeve or coating 64 may be placed around the outside of bracket 60 so that it will slide easier in track 43. Just outside rail 54 rod 62 has a nut 65 as a stop to limit the amount that rod 62 can move inward into track 43 as it is threaded into nut 61. When rod 62 is threaded into nut 61 and reaches its limit of advance by stop nut 65, further rotation of rod 62 by turning knob 63 draws nut 61 outward so that bracket 60 is brought to bear up against the inner surface of wall 48 of track 43 as illustrated in FIG. 4. Still further rotation of rod 62 causes bracket 60 to press against wall 48 and pull or draw carriage slide member 40 so that wing or arm 50 and/or wing or arm 51 of rail 44 on the opposite edge of carriage 11 are brought to bear against the corresponding walls 56 and/or 57 of track 53 so that rail 44 and track 53 are then in a tight non-sliding contact with one another. If rod 62 is further tightened, stop nut 65 bears strongly against the outside of rail 54 with enough force to bring the inner surface of rail 54 tightly against the outer surface of wall 48 of track 43 in the area designated by reference numeral 66 to even further lock together members 40 and 41. In this fashion, then, the two carriage members 40 and 41 are firmly locked to their slidably adjusted seat position and are clamped together along opposite edges so that they will not wobble or rock. To ensure that wall-to-wall contact is made at the area designated by reference numeral 66, the upper part of wall 48 may be made slightly thinner than the lower part so that there would be a slight gap between the upper part of wall 20 and rail 54 when the lower part of wall 20 is clamped tightly against rail 54 in the area designated by reference numeral 66.

While the sequence of operation of the clamping of the carriage slide members has been described based upon an analysis and some actual observations, it is quite possible and likely that there is interaction such that the clamping of the rails to the tracks occurs at least in part concurrently. The sequence is not significant. The important feature is that a relatively simple clamping mechanism coupled to one side of the two-member sliding carriage can be used to clamp the members tightly together along both edges to virtually eliminate any possibility of wobbling or rocking of the slide.

Near each end of the top wall 45 of track 43 is a stop (now shown) 70 which protrudes partly downward into the track opening. This is to prevent the two slidable carriage members 40 and 41 from sliding apart. The two members 40 and 41 can be slidably adjusted with respect to one another up to the limit where an edge of the captive nut bracket 60 strikes one of the stops. Since bracket 60 is located generally at about the center (lengthwise) of rail 54, it can be seen that carriage member 40 can be moved so that it overlaps about one-half of carriage member 41 at its most forward limit and overlaps the other one-half of member 41 at its furthest rearward limit. This provides a fairly large area of slide adjustment while still maintaining a solid underside support.

I claim:

1. Apparatus for swivably mounting a seat to a supporting floor or boat deck or the like, said apparatus comprising:

a firs rigid flat, generally horizontal plate member;

means for coupling a seat to said first plate member;

a second rigid flat plate member parallel to and spaced just below said first plate member;

substantially large diameter, concentric, substantially identical circular openings through said first and second plate members:

a generally flat thin spacer between said plate members, said spacer having a central opening coextensive and concentric with the openings in said plate members, said spacer being rotatably slidably with respect to one of said plate members; and a rigid metal collar around the periphery of said central openings, said collar in contact with said plate members such that said plate members are slidably rotatable with respect to one another about said collar, said collar flared outward toward its upper and lower edges for holding together said plate members and said spacer;

the contact area between said collar and said plate members protecting the swivel apparatus against damage from forces which may be applied to the swivel in use; and a flat rigid retainer ring around the exterior of said collar adjacent a flared edge for holding said plate members and said spacer together in slidable contact.

2. The apparatus as described in claim 1 further including a second flat thin annular spacer around said collar resting between said retainer ring and one of said plate members.

3. The apparatus as described in claim 1 further including:

an elongated lever arm pivotably attached to one end to one of said plate members whereby said lever arm can be pivotally swung away from the plate member to which it is pivotably attached;

spring means attached to said lever arm for urging said lever arm toward the plate member to which it is pivotably attached;

an aperture in the plate member to which the lever arm is pivotably attached;

a series of apertures each about the same size as said first-mentioned aperture in the other plate member spaced around the central opening; and a pin on said lever arm for snugly but removably engaging said apertures, said pin engaging said first mentioned aperture and one of said series of apertures when said plate members are rotated with respect to one another so that the respective apertures are aligned to releasably lock said plate members against further rotation.

4. The seat mounting apparatus as described in claim 1 further including:

means for attaching one of said plate members to a supporting floor.

5. The apparatus as described in claim 4 wherein said first plate member si rectangular and said means for coupling a seat to said first plate member comprises:

a track along one edge of said first plate member and a rail along the opposite parallel edge of said first plate member;

a slide member having a generally rectangular rigid plate section, a rail along one edge of said slide member plate section slidably engaging said track on said first plate member and a track along the opposite parallel edge of said slide member plate section slidably engaging the rail on said first plate member;

clamping means coupled to only one of said tracks for releasably drawing both of said rails into pressing non-slidable contact with its associated track; and means for attaching a seat to said slide member.

6. The apparatus as described in claim 5 wherein:

said track on said slide member comprises a channel having a top wall defined by part of said plate section, a bottom wall, an inner wall and an outer wall, said outer wall having an elongated slotted opening; and said rail on said first plate member comprises a leg extending upward outside of the outer wall of said slide member channel, and a stud extending from said leg slidably engaged in said slotted opening in said slide member channel outer wall.

7. The invention as in claim 6 wherein said clamping means comprises:

a nut slideably resting in the channel of said slide member track; and means passing through the stud on said first plate member rail threadably engaged with said nut for forcing said nut against the outer wall of said slide member channel to draw said first plate member rail tightly non-slidably against said slide member track and said slide member rail tightly against said first plate member track.

8. The invention as in claim 6 wherein:

said first plate member track comprises a channel having an outer vertical wall, a downwardly angled upper wall and an upwardly angled lower wall; and said slide member rail includes angled V-shaped arms slidably engaged in said first plate member track along the angled upper and lower walls of said first plate member track.

9. The invention as in claim 8 wherein said clamping means comprises means for drawing said V-shaped arms tightly against the angled upper and lower walls of said first plate member channel and means for forcing the leg of said first plate member rail tightly against the outer wall of said slide member track.

* * * * *